US010337265B1

(12) United States Patent
le Vann et al.

(10) Patent No.: US 10,337,265 B1
(45) Date of Patent: Jul. 2, 2019

(54) WELL PIPE GUIDE SPOOL

(71) Applicants: Deep Well Services, Zelienople, PA (US); Consolidated Rig Works, LP, Fort Worth, TX (US)

(72) Inventors: Brian Edward le Vann, Sewickley, PA (US); Steven Michael Byra, McDonald, PA (US); Caleb Everett McKendree Fulks, McKinney, TX (US)

(73) Assignees: Deep Well Services, Zelienople, PA (US); Consolidated Rig Works, LP, Fort Worth, TX (US)

( * ) Notice: Subject to any disclaimer, the term of this patent is extended or adjusted under 35 U.S.C. 154(b) by 0 days.

(21) Appl. No.: 16/111,944

(22) Filed: Aug. 24, 2018

(51) Int. Cl.
*E21B 19/24* (2006.01)
*E21B 33/06* (2006.01)

(52) U.S. Cl.
CPC ..... *E21B 19/24* (2013.01); *E21B 33/061* (2013.01)

(58) Field of Classification Search
CPC ..... E21B 33/06; E21B 33/061; E21B 33/062
See application file for complete search history.

(56) References Cited

U.S. PATENT DOCUMENTS 1,709,949 A * 4/1929 Rasmussen ..... E21B 33/06 137/613
2,721,614 A * 10/1955 Simmons ..... E21B 33/072 166/383
3,137,348 A * 6/1964 Ahlstone ..... E21B 7/128 166/208
3,142,343 A * 7/1964 Otteman ..... E21B 7/128 166/355
3,528,497 A * 9/1970 Lehman ..... E21B 7/128 166/360
3,884,298 A * 5/1975 Watkins ..... E21B 7/128 166/351
3,993,137 A * 11/1976 Hefetz ..... E21B 29/08 169/46
4,030,354 A * 6/1977 Scott ..... E21B 33/06 73/152.01
4,369,845 A * 1/1983 Henson ..... C09K 8/42 137/318
4,927,112 A * 5/1990 Wilson ..... E21B 33/062 251/1.3
5,567,138 A * 10/1996 Newton ..... E21B 19/24 166/68.5
5,595,248 A * 1/1997 Denny ..... E21B 19/10 166/241.6

(Continued)

*Primary Examiner* — Kipp C Wallace
(74) *Attorney, Agent, or Firm* — The Webb Law Firm

(57) ABSTRACT

A tubular guide assembly provides lateral support to a tubular extending through a BOP. The inner diameter of the BOP encasement is larger than the joint diameter. The assembly has a guide spool with a central bore extending therethrough along a longitudinal axis, wherein the diameter of the guide spool central bore is greater than the joint diameter of the tubular. At least two guide spool apertures extend radially inwardly through a wall of the guide spool to the central bore. A guide post for each guide spool aperture is movable through the respective guide spool aperture into the guide spool central bore to limit lateral displacement of a tubular extending therethrough. A method for providing lateral support to a tubular extending through a BOP during a snubbing operation uses their guide assembly.

25 Claims, 11 Drawing Sheets

(56) References Cited

U.S. PATENT DOCUMENTS

| | | | | |
|---|---|---|---|---|
| 2003/0226248 | A1* | 12/2003 | McGuffin | E21B 19/24<br>29/525.01 |
| 2007/0137866 | A1* | 6/2007 | Ravensbergen | E21B 19/22<br>166/384 |
| 2012/0261194 | A1* | 10/2012 | Blange | E21B 7/18<br>175/67 |
| 2015/0275594 | A1* | 10/2015 | Mullins | E21B 19/10<br>166/78.1 |
| 2015/0361723 | A1* | 12/2015 | Mahoney | E21B 19/06<br>175/40 |
| 2016/0222750 | A1* | 8/2016 | Williams | E21B 33/061 |
| 2017/0074060 | A1* | 3/2017 | Evans | E21B 19/24 |
| 2017/0314354 | A1* | 11/2017 | Molaschi | E21B 29/08 |
| 2018/0363789 | A1* | 12/2018 | Nguyen | F16K 15/03 |

* cited by examiner

WELL PIPE GUIDE SPOOL

BACKGROUND OF THE INVENTION

Field of the Invention

The invention relates to the snubbing of wells and, more particularly, to a guide assembly associated with the blowout preventer stack (BOP) to minimize tubular deflection within the BOP during a snubbing operation.

Description of Related Art

A live well is a well that has a pressure greater than atmospheric pressure. During well preparation, tubulars must be inserted and withdrawn from the well as needed during snubbing operations. However, any tubulars extending from above-ground into the well are subjected to forces created by this well pressure which attempts to eject the tubular from the well, hereinafter referred to as the ejection force. In general, the tubular is somewhat flexible to navigate the wellbore. However, this same flexibility may allow the tubular to buckle under compressive loads imposed during snubbing operations.

For safety, all live wells have at the transition to atmospheric pressure a blowout preventer stack (BOP). The BOP is a configuration of specialized valves, rams, and annulars used to seal, control and monitor the well to prevent the uncontrolled release of gas or oil from the well. The BOP forms a pressure boundary between the pressurized well and the atmosphere.

A simplified schematic of a portion of a BOP 5, illustrated in FIG. 1, is made up an annular preventer 10, an upper pipe ram 15, and a lower pipe ram 20. While there are other rams within the BOP, such as shear rams, for purposes of this discussion, only the elements in FIG. 1 will be discussed. With the exception of the guide assemblies 100, 200 to be discussed, the remainder of FIG. 1 is prior art.

In a live well, the annular space 25 within a casing 30 extending into the wellbore of a well 35 is pressurized by the well pressure. Tubulars, such as tubular 40, are inserted and withdrawn into the annular space 25 of the well 35 against the well pressure, which exerts an ejection force F attempting to expel the tubular 40 from the wellbore. The tubular 40 is moved into and out of the wellbore against the well pressure through a process known as snubbing. Snubbing is achieved through the use of various hydraulic systems (cylinders, inverted slips, stripping BOP's, etc.) working in conjunction with each other to insert the tubular into or withdraw the tubular from the wellbore.

During normal operation, the annular preventer 10 surrounds and is urged against the external surface of the tubular 40 to create a pressure boundary while at the same time allowing the tubular 40 to slide through the annular preventer 10 to be inserted or withdrawn from the wellbore.

However, a tubular string is made up of multiple tubular segments connected to one another by joints, such as joint 45. Up to certain well pressures, this joint 45 can pass through the closed annular preventer 10 without the need to utilize the rams 15 and 20. If well pressures exceed the tolerance of the annular preventer 10, it becomes necessary to utilize the rams 15 and 20 in the BOP 5. When it is necessary to utilize the rams 15 and 20 in the BOP 5, in order to pass a tubular joint 45 through the BOP 5, the upper ram 15 and the lower ram 20 must be sequentially opened and closed to allow the passage of joint 45 further into the well 35. It is during this time that the potential for buckling of the tubular within the BOP is the greatest.

The snubbing process applies axial compressive forces FS to the tubular 40 opposing the ejection force F and, as a result, the tubulars are prone to buckling, especially within the region of the BOP. Although the ejection force F acting on the tubular 40 originates from pressure in the well 35, the region of most concern is above the pressure boundary. For purposes of discussion herein, the pressure boundary may occur at the annular preventer 10, the upper pipe ram 15 or the lower pipe ram 20.

The inner diameter of the BOP encasement may be about 7 inches and the outer diameter of tubular within the BOP encasement may be up to 3½ inches. As a result, there may be a significant lateral gap between the tubular with the inner wall of the BOP 5. However, the annular preventer 10, the top pipe ram 15 and the bottom pipe ram 20 may offer lateral support to the tubular as it passes through the BOP 5.

A device is needed whereby the potential for tubular buckling within the BOP is minimized.

SUMMARY OF THE INVENTION

In one embodiment of the invention, a guide assembly is utilized to provide lateral support to a tubular extending through a BOP. The BOP has an encasement with an inner diameter. The tubular has a base diameter and a joint diameter. The inner diameter of the BOP encasement is larger than the joint diameter. The assembly has a guide spool with a central bore extending therethrough along a longitudinal axis. The diameter of the guide spool central bore is greater than the joint diameter of the tubular. The assembly also has at least two guide spool apertures extending radially inwardly through a wall of the guide spool to the central bore and a guide post for each guide spool aperture. Each guide post is movable through the respective guide spool aperture into the guide spool central bore to limit lateral displacement of a tubular extending therethrough.

In another embodiment of the invention, a method provides lateral support to a tubular extending through a BOP during a snubbing operation using a guide assembly described herein. The method comprises the steps of:

a) positioning the guide posts longitudinally between two pipe rams; and b) securing the guide posts inwardly within the BOP to contact or to create a gap between the guide posts and the base diameter of the tubular of about 0-60% of the tubular OD to provide lateral support to the tubular within the BOP.

DESCRIPTION OF THE INVENTION

Figure 1:
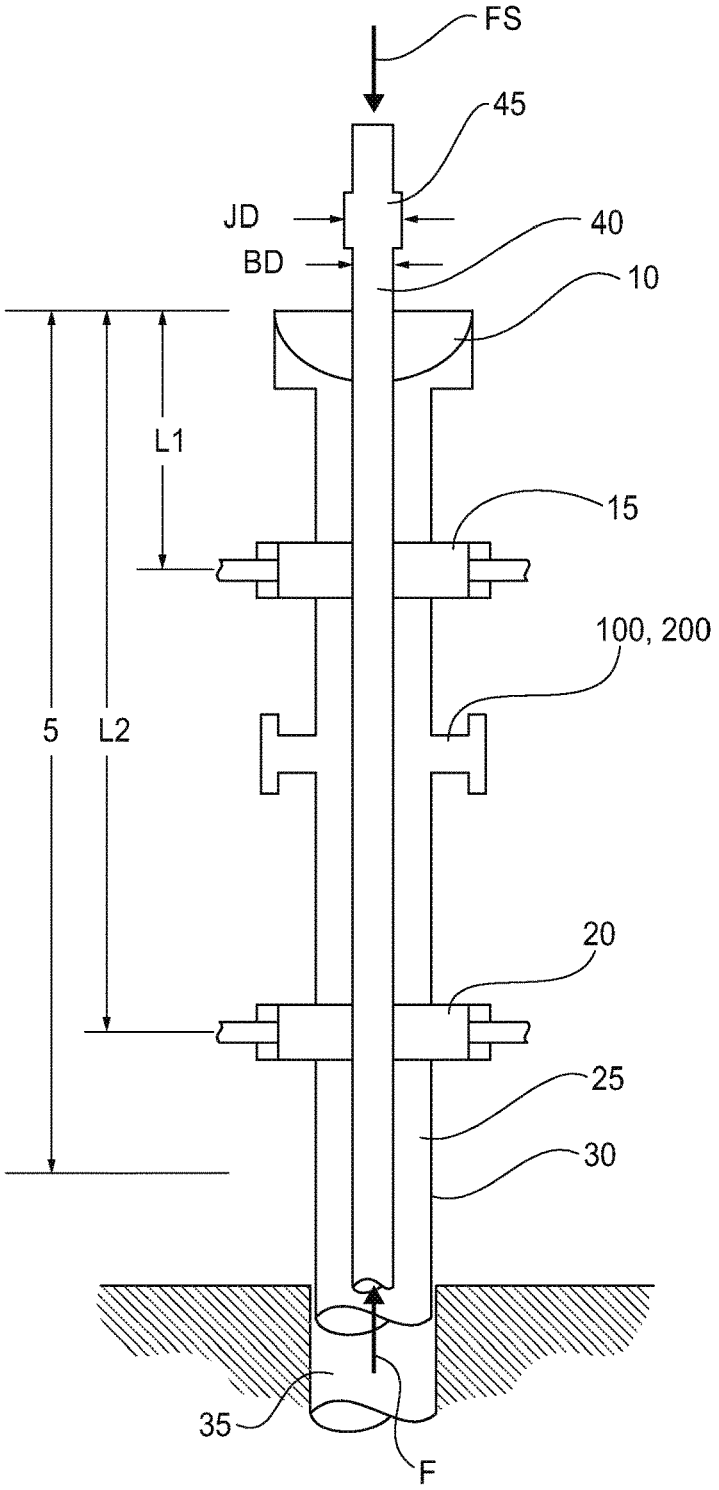
FIG. 1 illustrates a general schematic of a BOP with a tubular extending therein.

With reference to FIG. 1, there are essentially three steps for passing a tubular joint 45 through the BOP 5 when well pressure exceeds the tolerance of the annular preventer 10. These steps will be described for a snubbing unit moving the tubular 40 into the BOP 5.

The annular preventer 10, separated from the upper pipe ram 15 by a length L1, remains closed during the snubbing process. In a first step, the joint 45 of the tubular 40 is advanced against the ejection force F past the annular preventer 10 and up to the closed upper pipe ram 15. This unsupported length L1 is relatively short. In a second step, the upper pipe ram 15 is opened and the lower pipe ram 20, which is a length L2 from the annular preventer 10, is closed to allow the joint 45 to advance within the BOP 5. During this step, the tubular 40 is laterally unsupported along the length L2 between the annular preventer 10 and the lower pipe ram 20, which is significantly longer than L1. The tubular 40 is advanced by force FS against the ejection force F and this relatively long unsupported length L2 is vulnerable to buckling. In the third step, while joint 45 is between the upper pipe ram 15 and lower pipe ram 20, the upper pipe ram 15 is closed and the lower pipe ram 20 is opened to allow the joint 45 to pass into the well 35.

By introducing an additional lateral support between the upper pipe ram 15 and the lower pipe ram 20, the potential for buckling is significantly reduced.

Figure 2:
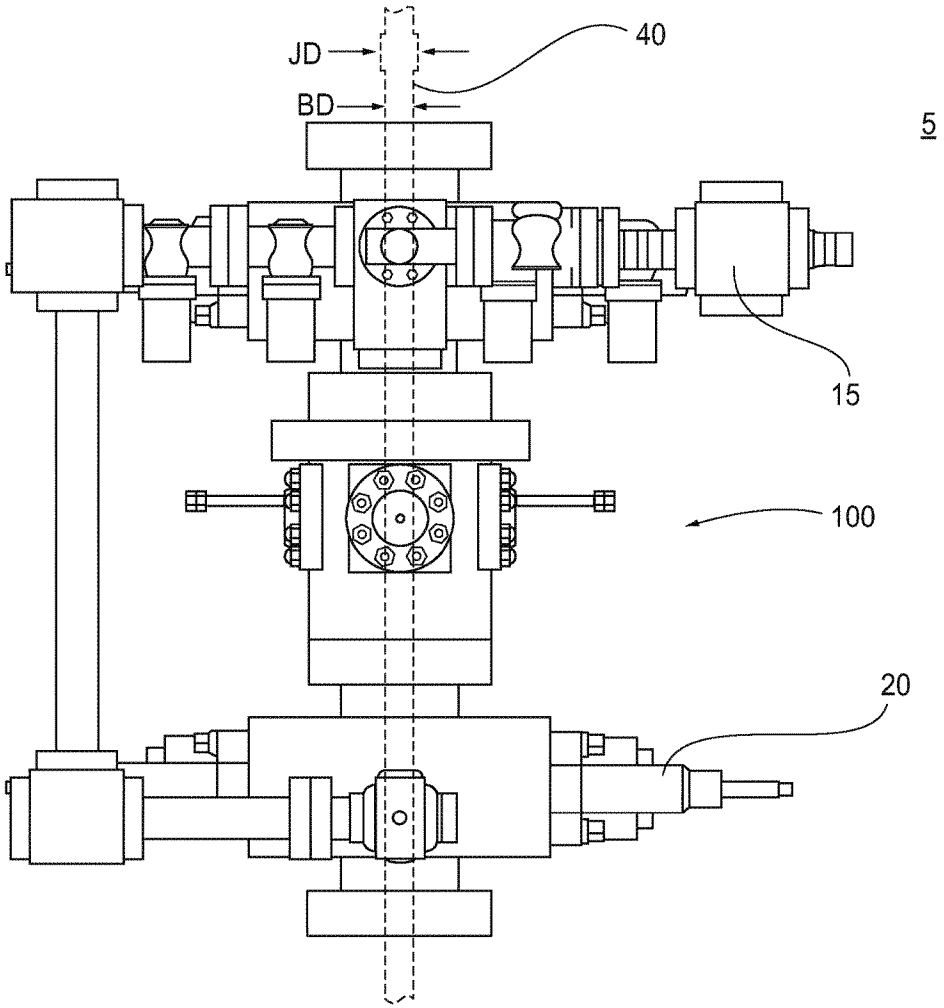
FIG. 2 illustrates a drawing of a portion of the BOP bounded by the upper pipe ram and the lower pip rams.

FIG. 2 illustrates a portion of the BOP 5 between the upper pipe ram 15 and the lower pipe ram 20. A well pipe guide assembly 100 provides such additional lateral support and is secured to the BOP 5 and located between the upper pipe ram 15 and the lower pipe ram 20. It should be appreciated that the tubular 40, shown in phantom, has an outer diameter BD and a joint diameter JD (FIG. 1).

The guide assembly 100 is adapted to provide lateral support to the tubular 40 extending through the BOP 5. As illustrated, the well pipe guide assembly 100 is symmetric and is made up of four quadrants. For convenience, the quadrant associated with guide spool aperture 110A will be discussed hereinafter with the understanding that this discussion is applicable to each of the remaining quadrants.

Directing attention to FIGS. 3-6, the well pipe guide assembly 100 is comprised of a guide spool 105 with a central bore 108 extending therethrough along a longitudinal axis L. The diameter DS of the guide spool central bore 108 is greater than the joint diameter JD (FIG. 1) of the tubular 40.

The guide spool 105 as illustrated has four guide spool apertures 110A-D extending radially inwardly through a wall 115 of the guide spool 105 to the central bore 108. Guide posts 120A-D are associated with each guide aperture 110A-D. Each guide post, for example 120A, is movable through the respective guide spool aperture 110A into the guide spool central bore 108 to limit lateral displacement of the tubular 40 extending therethrough.

Briefly returning to FIG. 1, as previously discussed, the well pipe guide assembly 100 is positioned along the longitudinal axis L between the upper pipe ram 15 and the lower pipe ram 20 of the BOP 5.

Figure 3:
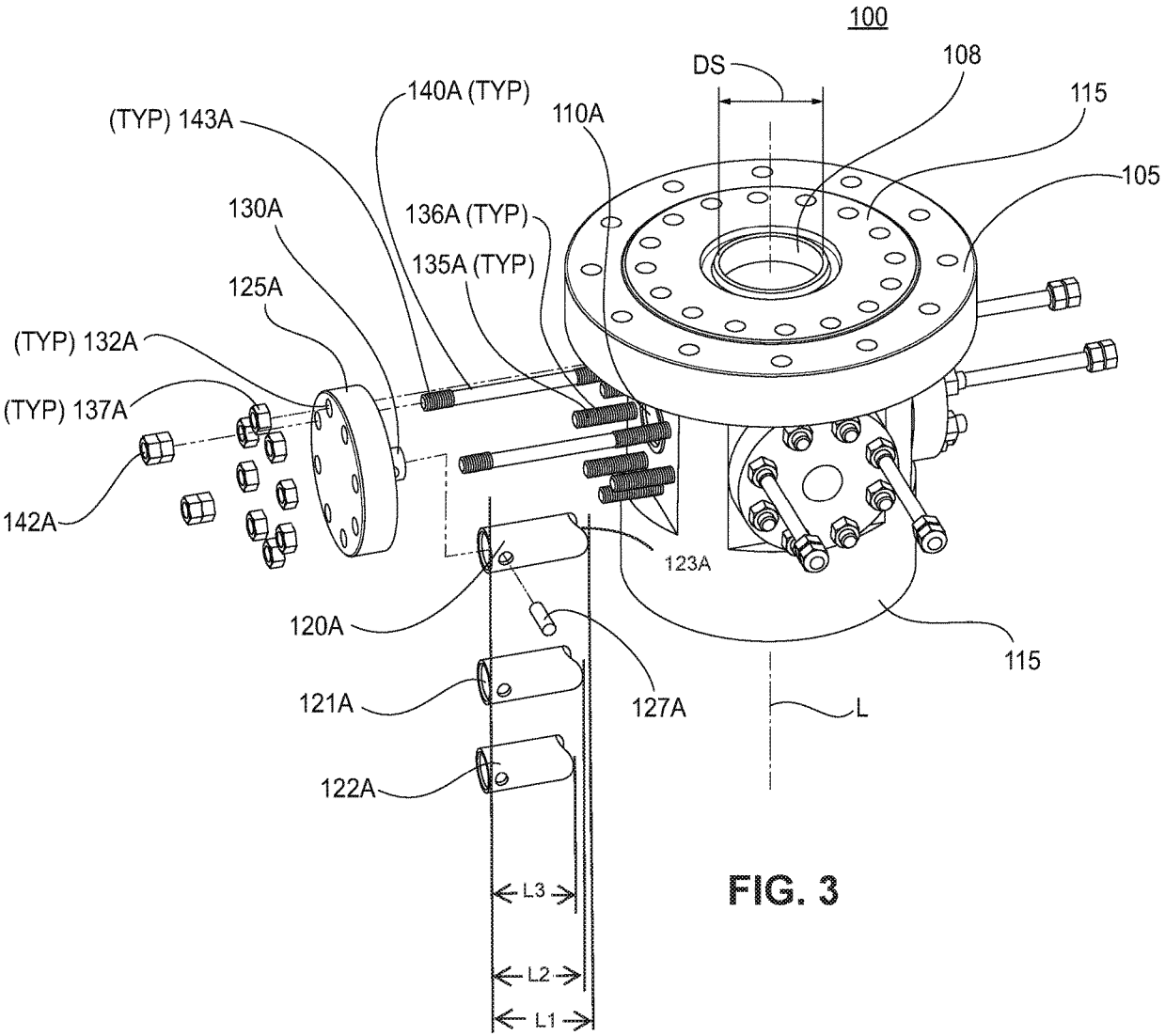
FIG. 3 illustrates a perspective exploded view of one embodiment of the well pipe guide assembly.

To accommodate tubulars 40 of different diameters, a series of guide posts 120A, 121A, 122A (FIG. 3), each typical of a set of four guide posts, may be interchanged within the guide spool 105. As an example, typical pipe sizes that may be utilized for well pipe include 2⅜ inch OD, 2⅞ inch OD, and 3½ inch OD. As a result, the guide posts 120A, 121A, 122A are selected as needed and it can be appreciated that different sets of guide posts are used for different tubular sizes. As illustrated in FIG. 3, each guide post 120A, 121A, and 122A has a different length L1, L2, and L3 respectively.

Figure 4:
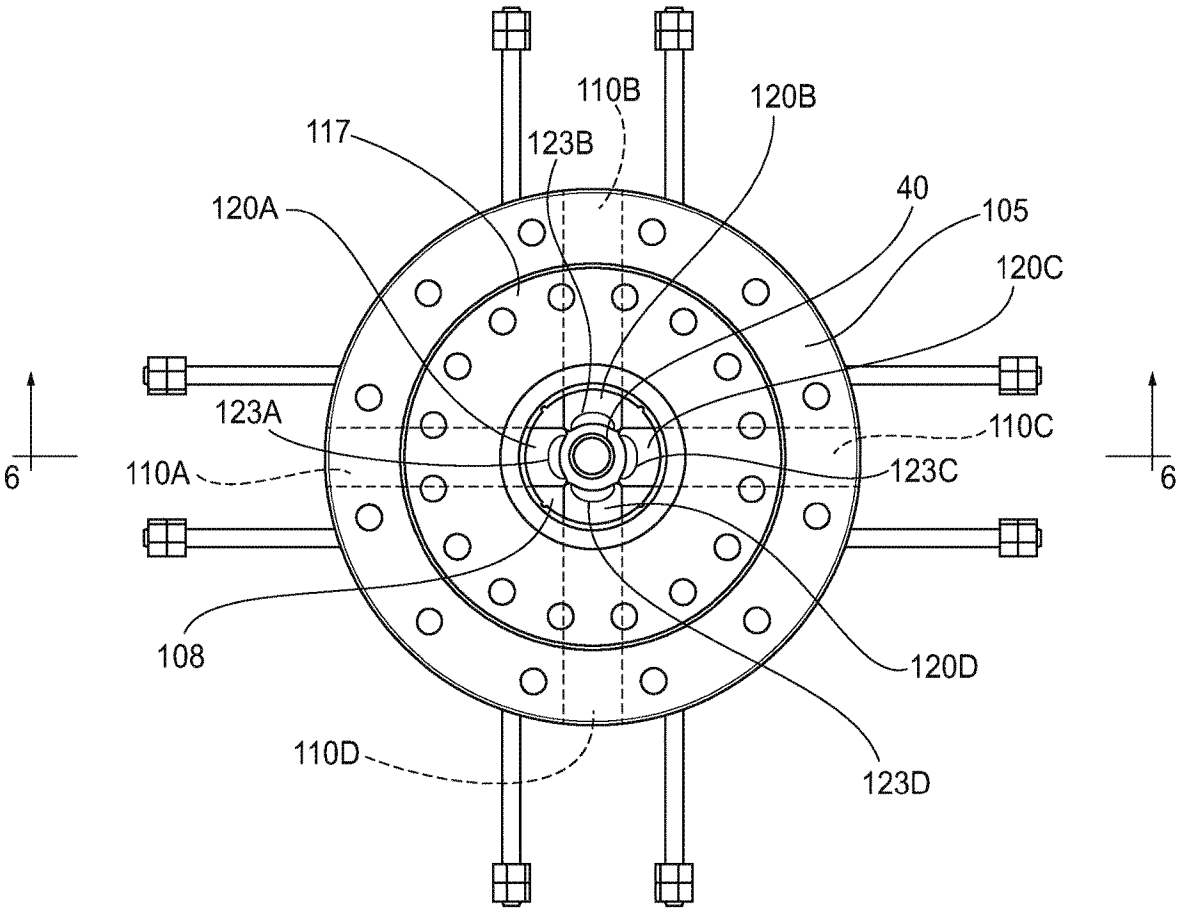
FIG. 4 illustrates a top view thereof.
Figure 5:
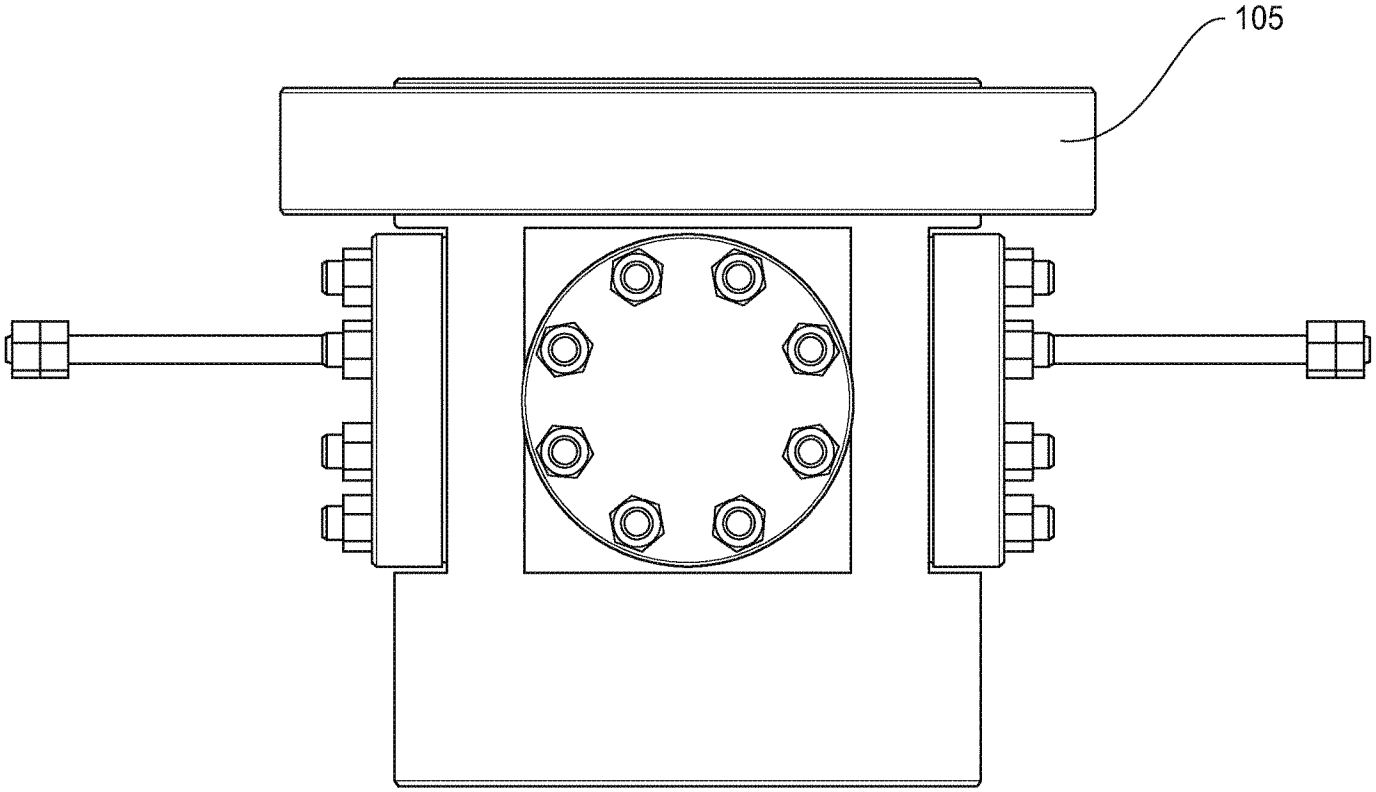
FIG. 5 illustrates a side view thereof.
Figure 7:
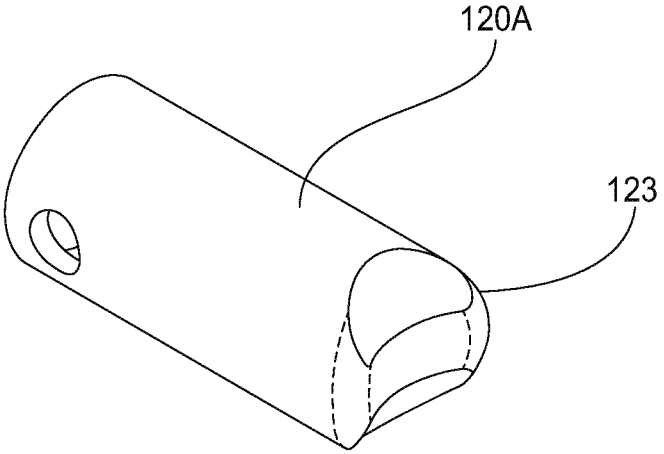
FIG. 7 illustrates a perspective view of a guide post discussed herein.

FIG. 7 shows a perspective view of guide post 120A and, in conjunction with FIGS. 3 and 4, it should be appreciated that each guide post such as 120A has a first end 123A that is curved to accommodate the shape of the tubular 40 to which it is intended to restrain. As illustrated in the figures, the guide posts 120A-D are oriented radially about the longitudinal axis L at 90 degree intervals. However, it is possible to include more or fewer guide spool apertures and guide posts located symmetrically about the longitudinal axis L. As an example, it is possible to orient three guide spool apertures at an angle of 120° relative to one another. As illustrated in FIG. 4, the first ends 123A-D of adjacent guide posts 120A-D abut with one another.

Figure 6:
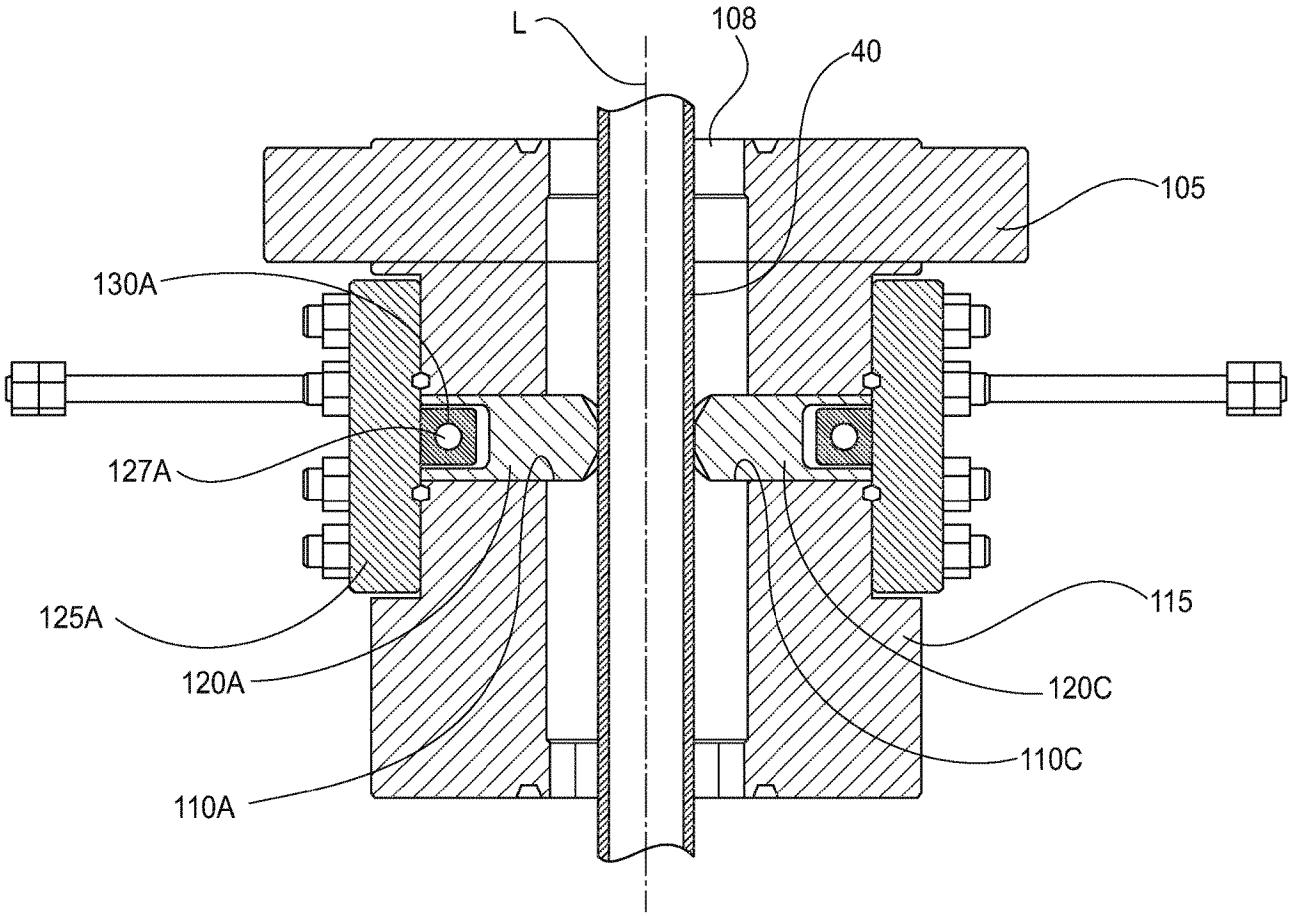
FIG. 6 illustrates a cross-sectional view along arrows 6-6 in FIG. 4.

The intent of the well pipe guide assembly 100 is to provide lateral support to the tubular 40 in the region of the BOP 5. Therefore, it is not necessary for the guide posts to make contact with the tubular 40 but only to prevent such lateral displacement that may minimize buckling. As a result, with each guide post 120A-D in a fully extended position as illustrated in FIGS. 4 and 6, within the central bore 108, a gap between the first end 123A-D of each guide post 120A-D and the tubular outer diameter BD may be between 0-60% of the tubular outer diameter BD. The guide posts 120A-D may be sized such that they contact the tubular 40 or provide a gap with respect to the tubular sufficient to provide lateral support to minimize the potential for buckling. In one embodiment, the guide posts 120A-D provide a sufficient gap with the tubular so that the joint 45 of the tubular 40 freely passes between the guide posts 120A-D wherein the gap is between 30-60% of the tubular outer diameter.

What has been discussed so far are common features of the invention illustrated in both the first embodiment shown in FIGS. 3-7 and in the second embodiment shown in FIGS. 8-12.

Directing attention to details of the first embodiment, as illustrated in FIGS. 3-7, with the understanding that the well pipe guide assembly 100 is symmetric, then the parts associated with only a single guide post, for example 120A, will be discussed with the understanding that the details associated with the remaining guide posts 120B-D are identical.

A flange 125A associated with the guide spool aperture 110A is secured to the guide spool 105 and a guide post 120A is attached to the flange 125A. The guide post 120A is removably attached to the flange 125A and, in particular, guide post 120A is attached to a projection 130A extending from the flange 125A. A removable lock pin 127A extends through the guide post 120A and the projection 130A to secure the guide post 120A to the flange 125A. In this fashion, the guide post 120A is removably attached to the flange 125A.

As further illustrated in FIG. 3, the flange 125A has retention holes 132A extending therethrough and the guide spool 105 has aligned threaded retention studs 135A such that the flange 125A may be placed over the retention studs 135A and retained against the guide spool 105 with nuts 137A engaging threads 136A on the retention studs 135A.

During most of the snubbing operation, the guide posts 120A-D are urged toward the outer diameter BD of the tubular 40 to provide a gap previously defined. The gap is sized to permit passage of the tubular joint 45. However, in another embodiment to provide further lateral support to the tubular 40, the gap may be smaller than the tubular joint 45 diameter JD. Under these conditions, the nuts 137A are rotated so that the flange 125A and the associated guide post 120A are withdrawn from the guide spool aperture 110 to provide adequate clearance. There also are instances where the tubular 40 is changed to a pipe having a different diameter and, as a result, the guide post 120A-D must be replaced with guide post that can accommodate a different size tubular, such as the set of guide posts associated with guide post 121A, 122A. Once again, the flange 125A must be withdrawn sufficiently from the guide spool 105 to provide adequate clearance for replacing the guide post 120A. Under these circumstances, the flange 125A may be withdrawn beyond the length of the retention studs 135A.

The guide spool 105 may further include slide studs 140A which engage matching retention holes 132A on the flange 125A and may have end caps 142A engaging with threads 143A to retain the flange 125A when unsecured from the retention studs 135A. In the alternative, the nut 137A associated with each retention stud 135A may engage the threads 143A to retain the flange 125A and the end caps 142A may be eliminated. The matching holes 132A on the flanges 125A have an inner diameter larger than the outer diameter of the slide stud 140A thereby allowing the flanges 125A to slide over the slide stud 140A. As illustrated in FIG. 3, the slide studs 140A are extensions of the retention studs 135A.

The embodiment illustrated in FIGS. 3-6 require the loosening and tightening of multiple nuts 137A when it is necessary to replace the guide post with different sizes 120A or adjust the guide post to allow for passage of the tubular joint 45. The second embodiment of the invention illustrated in FIGS. 8-12 allows this positioning through the rotation of a single nut.

It should be appreciated that the guide spool 105 may be identical and, for that reason, part numbers associated with the guide spool 105 will be repeated herein while the well pipe guide assembly will be referred to as 200.

Just as before, the well pipe guide assembly 200 is symmetric and, for convenience, a single quadrant, for example, that quadrant associated with flange 225A will be discussed with the understanding that the remaining quadrants, such as those associated with the flange 225B-D will be identical. Directing attention to FIGS. 8 and 11, the flange 225A associated with guide spool aperture 210A and is secured to the guide spool 105. The flange 225A has flange aperture 226A therethrough. The flange aperture 226A is collinear with the guide spool aperture 210A to accept the guide post 220A. The flange 225A has retention holes 232A extending therethrough and the guide spool 105 has aligned guide spool retention holes 236A. The flange 225A is retained against the guide spool 105 with threaded studs 238A extending therethrough.

The flange 225A has a threaded neck 250A and the assembly 200 further includes a threaded hammer nut 255A that engages the threaded neck 250A and secures the guide post 220A within the guide spool aperture 210A. A bull plug 260A between the guide post 220A and the hammer nut 255A is urged against the shoulder 252A of the threaded neck 250A by the hammer nut 255A to secure the guide post 220A within the guide spool aperture 210A. In particular, the bull plug 260A has a head 262A that is engaged by a shoulder 257A of the hammer nut 255A. The guide post 220A is removably attached to the bull plug 260A. In particular, a removable lock pin 265A extends through the guide post 220A and the bull plug 260A to secure the guide post 220A to the flange 225A.

Figure 12:
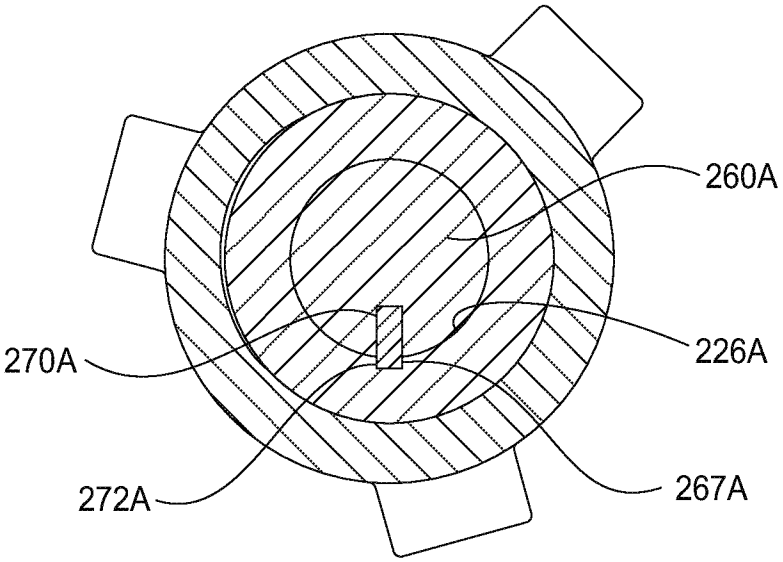
FIG. 12 illustrates a cross-sectional view along arrows 12-12 in FIG. 10.
Figure 8:
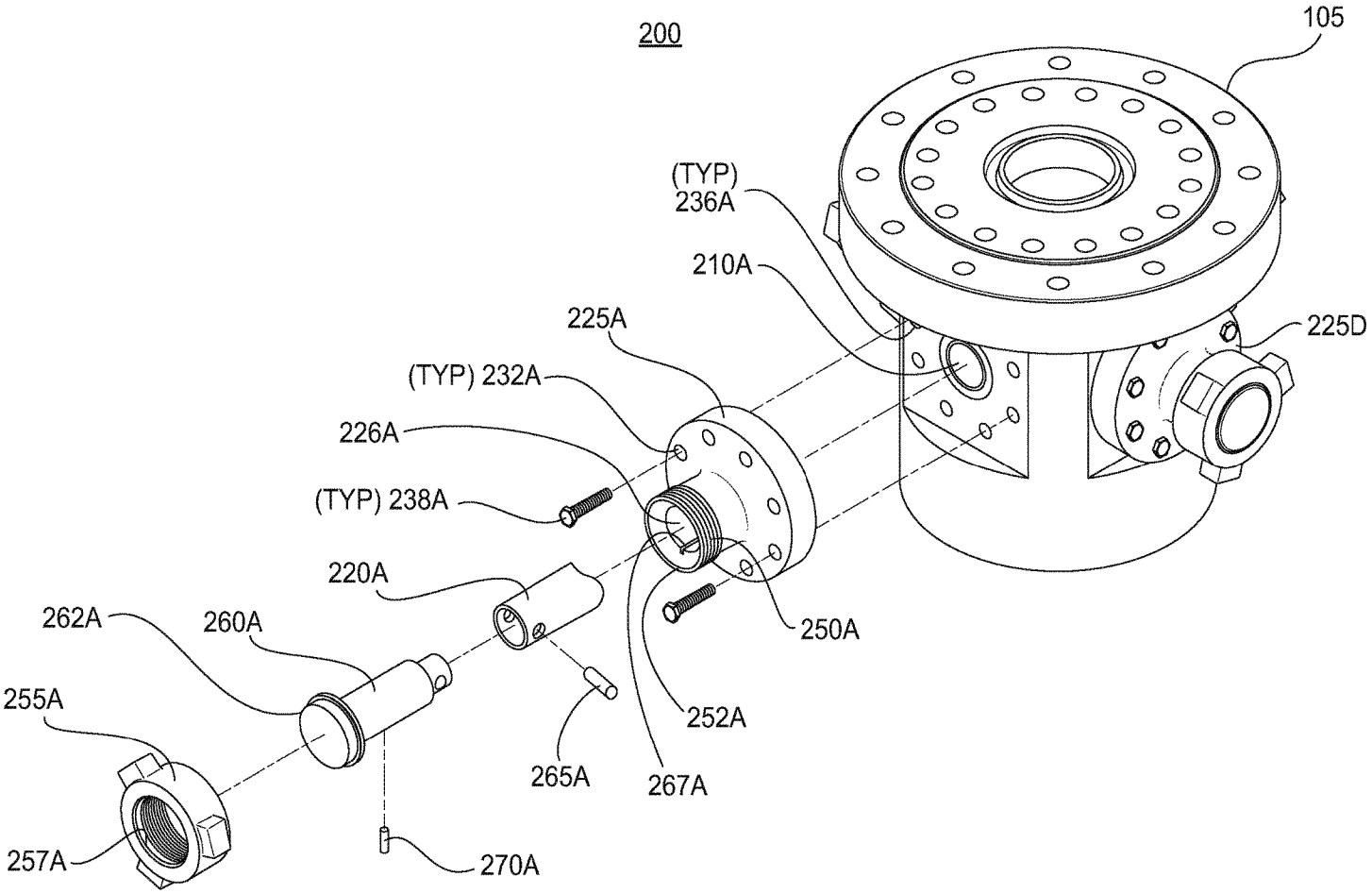
FIG. 8 illustrates an exploded perspective view of a second embodiment of the well pipe guide assembly.
Figure 9:
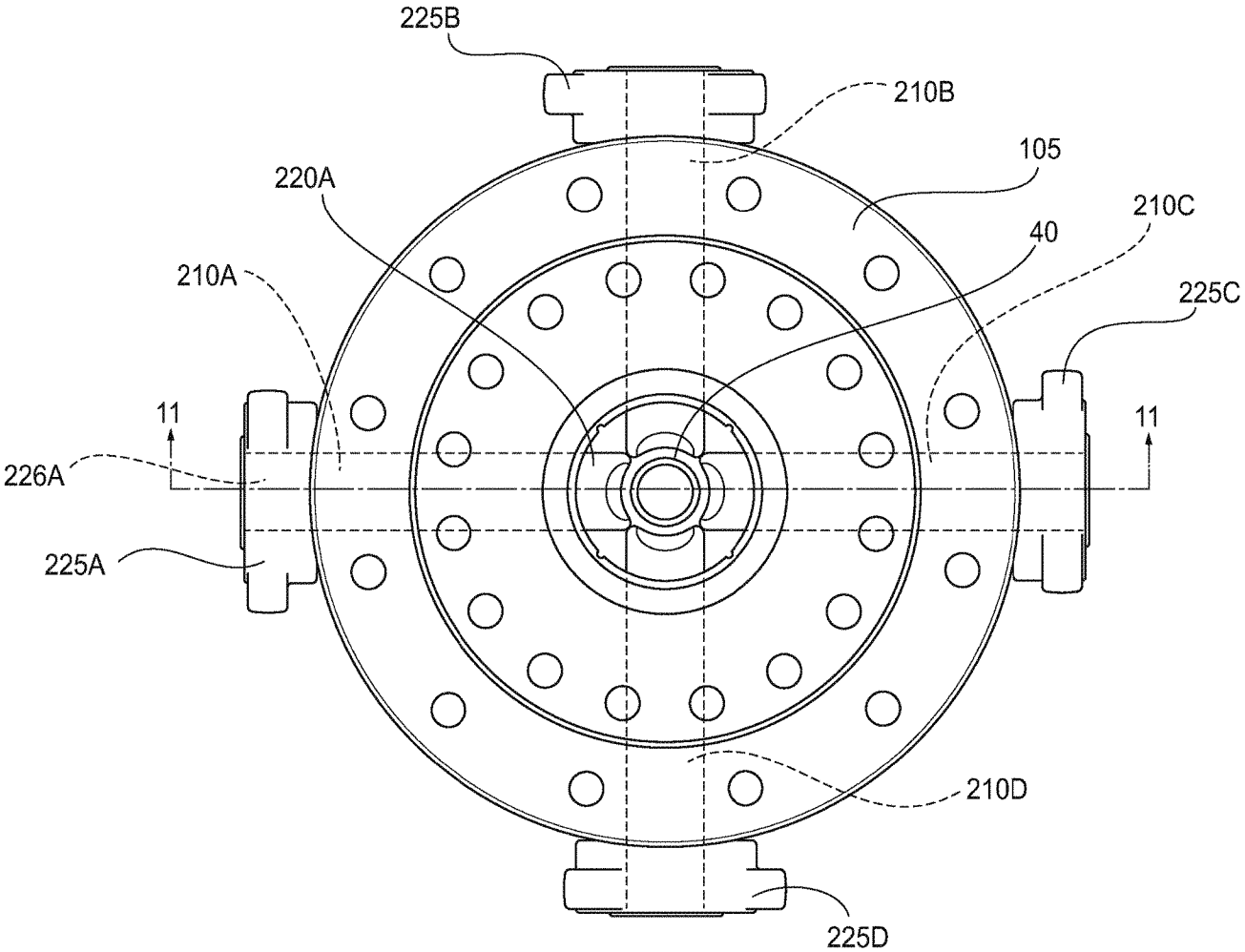
FIG. 9 illustrates a top view thereof.
Figure 10:
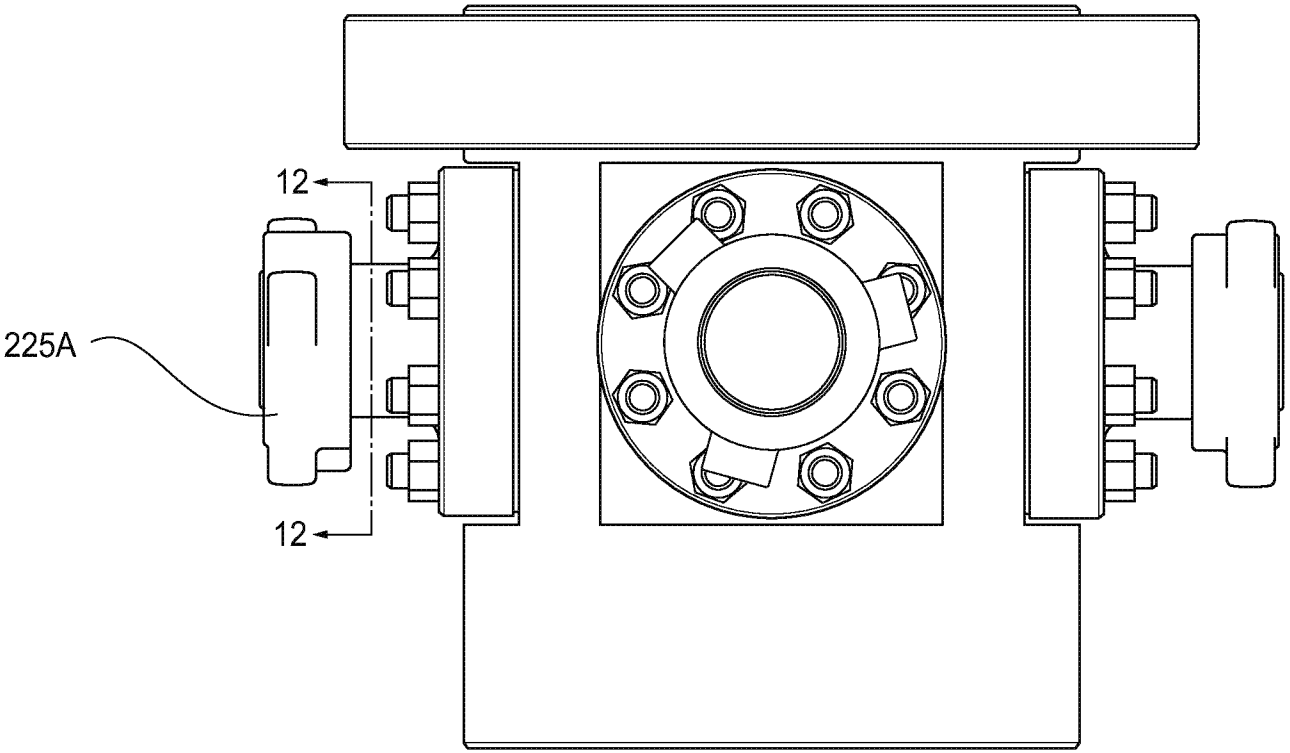
FIG. 10 illustrates a side view thereof.

Directing attention to FIGS. 8 and 12, a groove 267A within the flange aperture 226A and a groove 270A within the bull plug 260A receive a key 272A to hold the bull plug 260A non-rotatable within the flange aperture 226A, which is non-rotatably secured to the guide spool 105.

Figure 11:
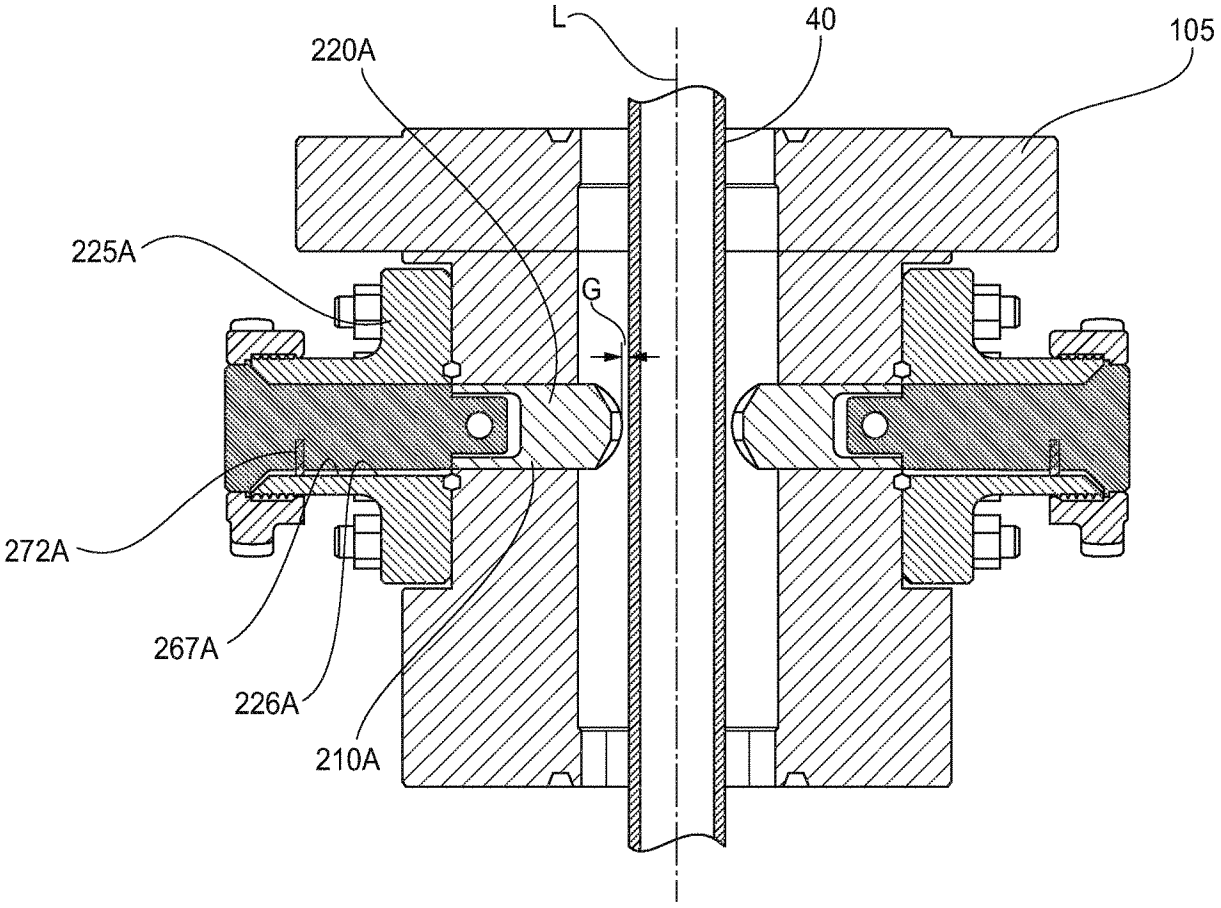
FIG. 11 illustrates a cross-sectional view along arrows 11-11 in FIG. 9.

For illustration, FIG. 6 shows the guide posts 120A, 120C in contact with the tubular 40 such that there is no gap. FIG. 11 shows the guide posts 220A, 220C spaced from the tubular 40 to define a gap G, which may be up to 60% of the outer diameter BD of the tubular 40.

A method for providing lateral support to a tubular 40 extending through the BOP 5 during a snubbing operation using a well pipe guide assembly 100, 200 as described herein comprises the steps of positioning the guide posts longitudinally between two pipe rams and securing the guide posts inwardly within the BOP to contact or to create a gap between the guide posts and the base diameter of the tubular of about 0-60% of the tubular OD to provide lateral support to the tubular within the BOP.

While certain embodiments of the invention are shown in the accompanying figures and described herein above in detail, other embodiments will be apparent to and readily made by those skilled in the art without departing from the scope and spirit of the invention. For example, it is to be understood that this disclosure contemplates that to the extent possible, one or more features of any embodiment can be combined with one or more features of the other embodiment. Accordingly, the foregoing description is intended to be illustrative rather than restrictive.

The invention claimed is:

1. A tubular guide assembly to provide lateral support to a tubular extending through a BOP, wherein the BOP has an encasement with an inner diameter, wherein the drill pipe has a base diameter and a joint diameter and the inner diameter of the BOP encasement is larger than the joint diameter, and wherein the assembly is positioned between rams of the BOP, the assembly comprises:

a) a guide spool with a central bore extending therethrough along a longitudinal axis, wherein the diameter of the guide spool central bore is greater than the joint diameter of the tubular;

b) at least two guide spool apertures extending radially inwardly through a wall of the guide spool to the central bore;

c) a first guide post for each guide spool aperture, wherein each first guide post has a first guide post length to accommodate a tubular having a first diameter;

d) a second guide post for each guide spool aperture, wherein each second guide post has a second guide post length different from the first guide post length to accommodate a tubular having a second diameter different from the first diameter; and e) wherein, depending upon the diameter of the tubular, one of the first guide post or the second guide post is fixed within each respective guide spool aperture and extends into the guide spool central bore to limit lateral displacement of the tubular extending therethrough.

2. The guide assembly according to claim 1, wherein the guide posts are positioned along the longitudinal axis between an upper and a lower pipe ram on the BOP.

3. The guide assembly according to claim 1, wherein each guide post is held non-rotatable within the respective guide spool aperture.

4. The guide assembly according to claim 1, wherein each guide post has a first end that is curved to accommodate the shape of the tubular.

5. The guide assembly according to claim 1, wherein the guide posts are oriented radially about the longitudinal axis at 90 degree intervals.

6. The guide assembly according to claim 1, wherein the first ends of adjacent guide posts abut with one another.

7. The guide assembly according to claim 1, wherein with each guide post in a fully extended position within each guide spool aperture, a gap between a first end of each guide post and the tubular outer diameter is between 0-60% of the tubular outer diameter.

8. The guide assembly according to claim 7, wherein the gap between the first end of each guide post and the tubular outer diameter is between 30-60% of the tubular outer diameter.

9. The guide assembly according to claim 1, wherein a flange associated with each guide spool aperture is secured to the guide spool and wherein a guide post is attached to each flange.

10. The guide assembly according to claim 9, wherein a guide post is removably attached to each flange.

11. The guide assembly according to claim 10, wherein each guide post is attached to a projection extending from each flange.

12. The guide assembly according to claim 11, wherein removable lock pins extend through each guide post and projection to secure each guide post to a respective flange.

13. The guide assembly according to claim 1, wherein each flange has retention holes extending therethrough and the guide spool has aligned threaded retention studs such that each flange may be place over the retention studs and retained against the guide spool with nuts engaging the retention studs.

14. The guide assembly according to claim 1, wherein the guide spool further includes slide studs which engage matching holes on the flange, wherein the matching holes have an inner diameter larger than the diameter of the slide studs thereby allowing the flange to slide over the slide studs.

15. The guide assembly according to claim 14, wherein the slide studs are extensions of the retention studs and the nuts engaging the retention studs also engage the slide studs to retain the flange when the flange is not retained against the guide spool.

16. The guide assembly according to claim 1, wherein a flange associated with each guide spool aperture is secured to the guide spool and wherein each flange has a flange aperture therethrough, wherein the flange aperture is co-linear with the guide spool aperture to accept the guide post.

17. The guide assembly according to claim 16, wherein each flange is integral with the guide spool.

18. The guide assembly according to claim 16, wherein each flange has retention holes extending therethrough and the guide spool has aligned guide spool retention holes such that the flanges may be place over the guide spool retention holes and retained against the guide spool with threaded studs extending therethrough.

19. The guide assembly according to claim 16, wherein each flange has a threaded neck and the assembly further includes a threaded hammer nut that engages the threaded neck and secures each guide post within the respective guide spool aperture.

20. The guide assembly according to claim 19, further including a bull plug between the guide post and hammer nut, wherein the bull plug is urged against the flange aperture shoulder by the hammer nut to secure the guide post within the guide spool aperture.

21. The guide assembly according to claim 20, wherein the guide posts are removably attached to a bull plug and the bull plug is non-rotatable within the guide spool aperture.

22. The guide assembly according to claim 21, wherein removable lock pins extend through each guide post and bull plug to secure each guide post to a respective flange.

23. The guide assembly according to claim 21, wherein the bull plug has a head that is engaged by the hammer nut shoulder.

24. The guide assembly according to claim 22, wherein the guide post is non-rotatable through a key/groove relationship between the flange aperture and the bull plug.

25. A method for providing lateral support to a tubular extending through a BOP during a snubbing operation using a guide assembly according to claim 1, comprising the steps of:

a) positioning the guide posts longitudinally between two pipe rams; and b) securing the guide posts inwardly within the BOP to contact and to create a gap between the guide posts and the base diameter of the tubular of about 0-60% of the tubular OD to provide lateral support to the tubular within the BOP.

* * * * *